United States Patent [19]

Kanazawa

[11] Patent Number: 4,499,552

[45] Date of Patent: Feb. 12, 1985

[54] ELECTROCHEMICAL CELL SIMULATING CIRCUIT ARRANGEMENT

[75] Inventor: Kay K. Kanazawa, San Jose, Calif.

[73] Assignee: International Business Machines Corporation, Armonk, N.Y.

[21] Appl. No.: 336,128

[22] Filed: Dec. 31, 1981

[51] Int. Cl.[3] ..... G06G 7/58

[52] U.S. Cl. ..... 364/802; 364/861

[58] Field of Search ..... 364/800, 801, 802, 803, 364/861

[56] References Cited

U.S. PATENT DOCUMENTS

| | | | |
|---|---|---|---|
| 2,301,470 | 11/1942 | Starr | 364/802 |
| 2,523,453 | 9/1950 | Starr | 364/802 |
| 3,028,091 | 4/1962 | Johnson et al. | 364/802 |
| 3,034,228 | 5/1962 | Giloth | 364/802 X |
| 3,681,585 | 8/1972 | Todd | 364/803 X |
| 3,786,242 | 1/1974 | Brooks | 364/802 |
| 3,947,675 | 3/1976 | Mayn | 364/802 |
| 4,215,420 | 7/1980 | Kassakian | 364/802 |

*Primary Examiner*—Felix D. Gruber

*Attorney, Agent, or Firm*—G. E. Roush; Otto Schmid, Jr.

[57] ABSTRACT

An electronic circuit arrangement effecting current flow simulating the faradaic current, oxidation reduction potential and the like of an electrochemical cell encompasses two key concepts. The first recognizes that since the semi-integral of the cell current effectively deconvolves the diffusion aspect of the phenomenon with the resultant describing the surface concentration of reacted species, then the semiderivative of a function describing a surface concentration of reacted species results in an output representing the cell current, including diffusion. The second is embodied in a circuit arrangement properly simulating this concentration behavior cell double layer potential and in yielding an output proportional to the surface concentration of reactant species corresponding to that potential in response to applied cell barrier potential.

14 Claims, 7 Drawing Figures

ELECTROCHEMICAL CELL SIMULATING CIRCUIT ARRANGEMENT

FIELD

The invention relates to electrochemical cells, and it particularly pertains to electronic circuitry for simulating the electric characteristics of such cells.

BACKGROUND

Electrochemical cells are used for a variety of analytical procedures. The cell basically comprises a container for an electrolyte and three or more electrodes of which the principal ones are the auxiliary electrode (sometimes referred to as the counter electrode), the reference electrode and the working electrode. Electronic circuitry known as potentiostats and galvanostats are connected to the electrochemical cell electrodes for measuring potentials, currents and the like in the analytical process.

From time to time, it is desirable that a "standard cell" be available for calibrating the electronic potentio/galvanostatic circuitry. Obviously a given electrolyte in a given cell and previously analyzed would serve the purpose, but equally obvious is the fact that a large number of such "standard cells" are needed for adequate calibration of the electronic circuitry for accommodating a large variety of such cells.

To date the problem has usually been "solved" by a pair of adjustable resistors and an adjustable capacitor for roughly approximating the solution "compensated" resistance component, $R_c$, between the auxiliary electrode and the reference electrode; the solution "uncompensated" resistance component, $R_u$, (this designation is in current use although present day circuitry is available for compensation of this resistance also), and the "double layer" or barrier layer capacitance, $C_b$. A simple adjustable resistor shunting the adjustable capacitor has been used heretofore as a rough simulation of the conduction of faradaic current across the capacitor. Needless to say this approach has been far from satisfactory with the artisan. Thus there is a desire for an adjustable electronic circuit arrangement for obviating time consuming wet chemistry preparation and providing reproducible cell simulation of faradaic current flow resulting from diffusion limited reactions.

SUMMARY

The objects of the invention indirectly referred to hereinbefore and those that will appear as the specification progresses obtain with an electronic circuit arrangement using commercially available components for effecting current flow simulating the faradaic current, oxidation reduction potential and the like of a given electrochemical cell.

There are two key concepts. The first recognizes that since the semi-integral of the cell current effectively deconvolves the diffusion aspect of the phenomenon with the resultant describing the surface concentration of reacted species, then the semiderivative of a function describing a surface concentration of reacted species results in an output representing the cell current, including diffusion. The second recognizes that apparatus properly simulating this concentration behavior, must respond to the cell barrier "double layer" potential and thereby yields an output which is proportional to the surface concentration of reactant species corresponding to that potential.

PRIOR ART

There is little prior art of which the Applicant is aware relating to electrochemical pseudo cells and the equivalent. There is much prior art relating to electronic circuit simulators in general as is evidenced by the following few U.S. Patents:

U.S. Pat. No. 2,301,470, 11/1942, Starr, 364/802
U.S. Pat. No. 2,523,453, 9/1950, Starr, 364/802
U.S. Pat. No. 3,786,242, 1/1974, Brooks, 364/802
U.S. Pat. No. 3,947,675, 3/1976, Mayn, 364/802
U.S. Pat. No. 4,215,420, 7/1980, Kassakian, 364/802

These patents are directed to assemblies of electronic components arranged for delivering potentials and currents in such values, phase relationships and the like that another different but corresponding electronic circuit or electric circuit relationship is in effect simulated.

While the general concept of such simulation perhaps is suggested, this prior art is not anticipatory in any way of a simulator for the characteristics of an electrochemical cell in accordance with the invention.

DRAWING

In order that the advantages of the invention obtain in practice, the best mode embodiment thereof, given by way of example only, is described in detail hereinafter, with reference to the accompanying drawing, forming a part of the specification, and in which.

DESCRIPTION

Figure 1:
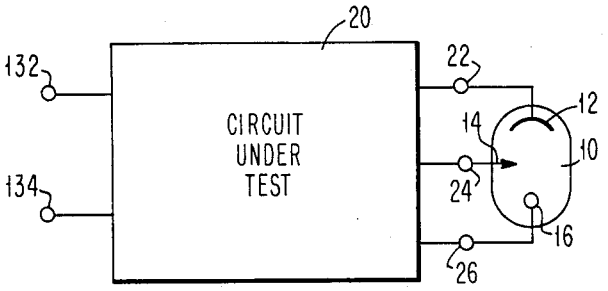
FIG. 1 is a diagram illustrating the arrangement for which the invention is intended.

The diagram in FIG. 1 depicts an electrochemical cell 10 comprising an electrolyte in a suitable container and in which an auxiliary electrode 12, a reference electrode 14 and a working electrode 16 are inserted. A circuit arrangement 20, to be calibrated for example, is connected to terminals 22, 24 and 26.

Figure 2:
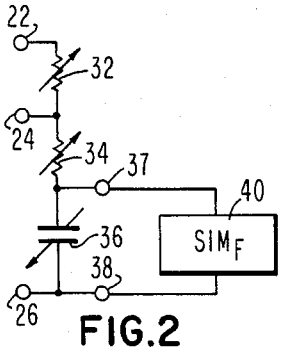
FIG. 2 is a diagram of a first reduction of the circuit according to the invention.

The cell 10 is simulated electrically in FIG. 2 by an adjustable resistor 32 substituting for the compensated solution resistance $R_c$, another adjustable resistor 34 substituting for the uncompensated solution resistance $R_u$ connected in series with an adjustable capacitor 36 substituting for the barrier layer, sometimes referred to as the "double layer" capacitance $C_b$ as shown with some additional measure taken in accounting for at least some approximation of faradaic current flow across the capacitor 36, as by a simple resistive element connected to the terminals 37 and 38. The latter expedient has proved to be quite unsatisfactory but for some time it was just about the only thing to do. In accordance with the invention an electronic simulating circuit arrangement 40 is so connected for simulating not only the faradaic current from diffusion limited reactions, but also affording variation of the oxidation-reduction potential, simulation of surface bonded species, simulation of one-electron and two-electron reactions, simulation of both anodic and cathodic currents, variation of the effective concentration of electroactive species, and the like as well. Such a simulation also can be used to rapidly and simply demonstrate the usefulness of a variety of electrochemical methods, for both marketing and instructional purposes. No time consuming preparative wet chemistry is involved. It can be used for industrial applications as a reference cell in the set up of electroanalytical instruments for specific purposes, or for calibration and instrument quality checks. Its versatility lends itself to methods development in the R&D environment.

Figure 3:
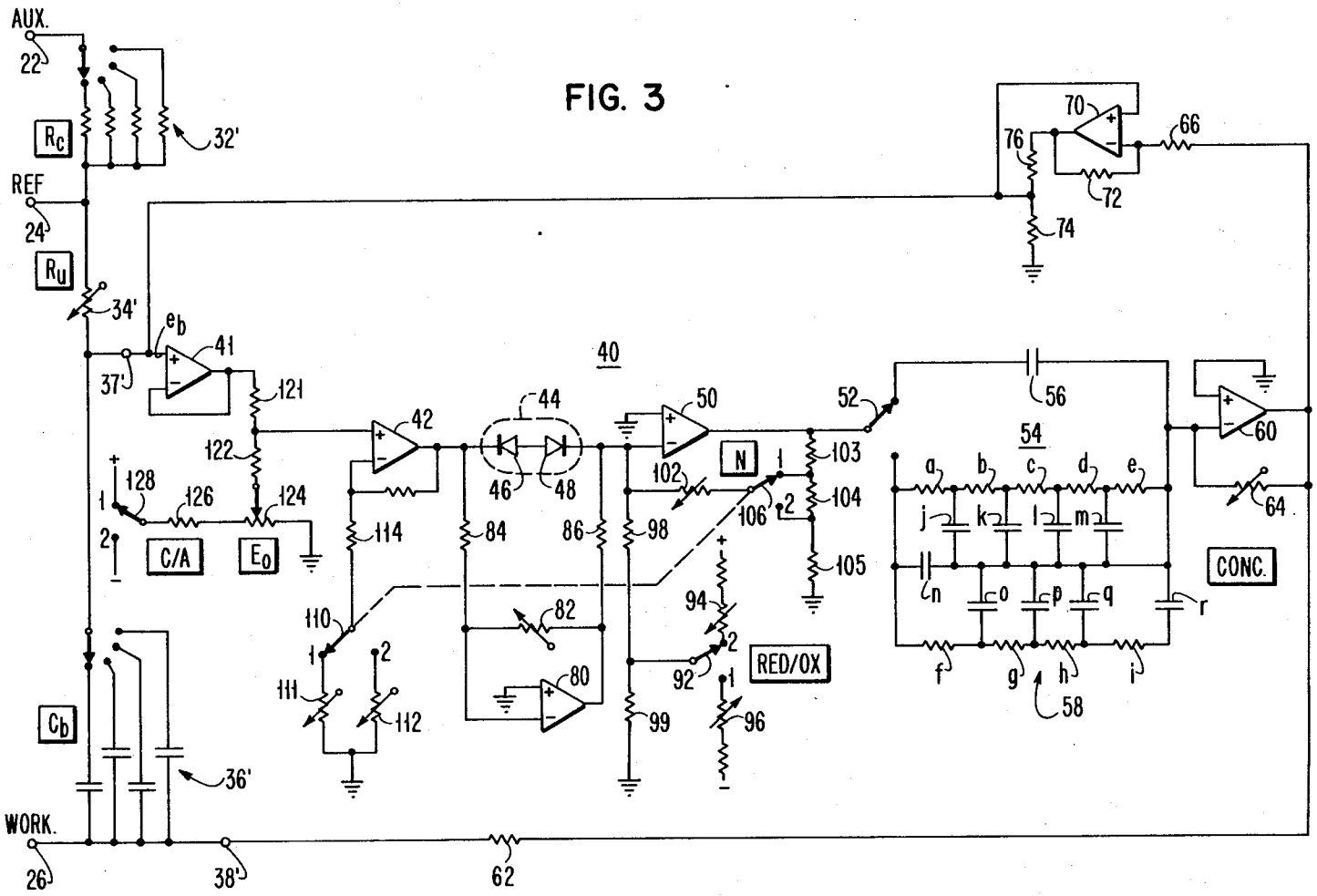
FIG. 3 is a schematic diagram of an electrochemical cell simulating circuit arrangement according to the invention.

A schematic diagram of one embodiment of a simulator 40 according to the invention is shown in FIG. 3. The component solution resistance $R_c$ which appears between the auxiliary electrode and the reference electrode of an electrochemical cell is represented by the switch-selected resistors 32' connected between the terminals 22 and 24, while the uncompensated solution resistance $R_u$ is represented by a continuously variable resistor 34' having one terminal connected to the terminal 24 and the barrier layer capacitance $C_b$ is represented by the switch-selected capacitors 36' connected between the other terminal of the resistor 34' and the working electrode terminal 26. The novel circuitry is connected across the capacitor 36' at the terminals 37' and 38'.

Values of components for a practical instrument are:

| Resistor 32' | Resistor 34' | Capacitor 36' |
|---|---|---|
| 10. ohms | 0–1 kilohm | 0.01 microfarad(s) |
| 100. ohms | adjustable | 0.1 microfarad(s) |
| 1. kilohm(s) | | 1.0 microfarad(s) |
| 10. kilohm(s) | | 10.0 microfarad(s) |

The terminal 37' is connected to one input terminal of a buffer amplifier 41 having an output terminal coupled to an adjustable gain amplifier circuit 42 which has an output terminal connected to a concentration simulator circuit 44 comprising a pair of diodes 46, 48 connected in series back-to-back. The simulator circuit 44 is connected to one input terminal of a differential operational amplifier 50 having an output terminal connected by a switch 52 to a selective circuit 54, comprising a capacitor 56 or a Warburg impedance circuit 58 and the input circuitry of a differential amplifier circuit 60. A resistor 62 connects the output terminal of the amplifier circuit 60 to the terminal 38' and an adjustable feedback resistor 64 couples this operational amplifier circuit. The output terminal of the latter circuit is connected by a resistor 66 to one input terminal of an operational amplifier circuit 70 having a feedback resistor 72. The other input terminal is connected to chassis by way of a resistor 74 and by way of another resistor 76 to output terminal of the amplifier 70. THe resistors 74 and 76 form a potential divider circuit which is connected to the terminal 37'.

The concentration simulator circuitry is completed according to one aspect of the invention by a compensating differential operational amplifier 80 having an adjustable feedback resistor 82 connected from the inverting input terminal to the output terminal, the latter of which are connected individually by resistors 84, 86 respectively to like terminals of the simulator 44. The other terminal of the amplifier circuit 80 is brought to chassis. The potential at the junction of the simulator 44 and the amplifier 50 is adjustable both in polarity and in value by means of a potential divider circuit having a polarity selecting switch 92 and two adjustable resistors 94 and 96 connected respectively to +and − energizing potential nodes. The arm of the switch is connected to the junction under consideration with a current limiting resistor 98 and to chassis by a resistor 99.

The intermediate amplifier circuit 50 is also completed in accordance with the invention by a feedback resistor 102. One input terminal is connected to the output terminal of the simulator circuit 44 and to a bilevel potential divider circuit comprising three resistors 103, 104, and 105 connected in series to chassis and a switch 106. The arm of the switch is connected to the one input terminal of the amplifier circuit 50, the other input terminal of which is brought directly to chassis. The other input terminal of the amplifier 42 is varied in potential and in level by means of two adjustable resistors 111 and 112. A current limiting resistor 114 brings the arm of the switch 110 to the amplifier 42.

The other input terminal of the amplifier 42 is connected by a potential divider circuit comprising resistors 121, 122, a potentiometer 124 connected between chassis and a further resistor 126 connected to the remote terminal of which is a switch 128 for selecting the −or 30 terminal of the power supply.

The simulating circuitry 40 is designed to be versatile and flexible; a variety of types of cells and sizes of cells are to be simulated. After the relatively simple resistance and capacitance simulation of $R_c$, $R_u$ and $C_b$, one of the first characteristics of an electrochemical cell to consider is the faradaic resistance $R_f$. This resistance is complex and requires much more than the selection of a simple resistor.

The faradaic behavior has been found to follow from Nernst's Law, which can be expressed by the equation:

$$E = E_s + \frac{RT}{nF} \ln \frac{[O]}{[M]} \quad (1)$$

where E is the applied potential in volts;

$E_s$ is the standard potential in volts;

R is the universal gas constant;

T is the absolute temperature;

F is Faraday's constant in coulombas/mole;

O is the solution concentration of the oxidized form;

M is the analogous solution concentration of the reduced form;

n is the number of electrons transferred in the elementary change transfer step.

Figure 4:
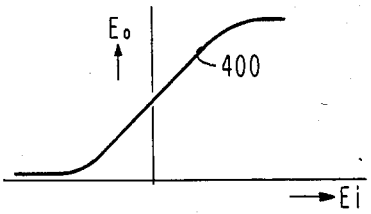
FIGS. 4–6 are graphical representations of circuit functions useful in an understanding of the operation of circuitry according to the invention.

FIG. 4 is a graphical representation of the variation of pertinent potentials in accordance with Nernst's Law as expressed in the form:

where $E_o$ is the output potential in volts $E_i$ is the input potential in volts The desired variations in accordance with this law is obtained by the use of the simulator 44 comprising a pair of type 1N34A germanium diodes 46 and 48. These diodes have a finite back resistance component, of course, which is compensated according to the invention with the operational amplifier 80 having an adjustable feedback resistor 82, both coupled to the simulator by the resistors 84 and 86 which values of 10 Kilohms and 100 Kilohms respectively. FIG. 4 is a graphical representation of the output potential obtained from a given range of input potential of a pair of back-to-back semiconductor diodes. Both silicon and germanium diodes exhibit this waveform; usually the germanium variety is used because the available output is greater.

Figure 5:
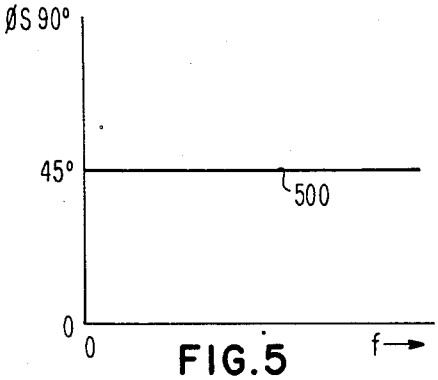
Figure 6:
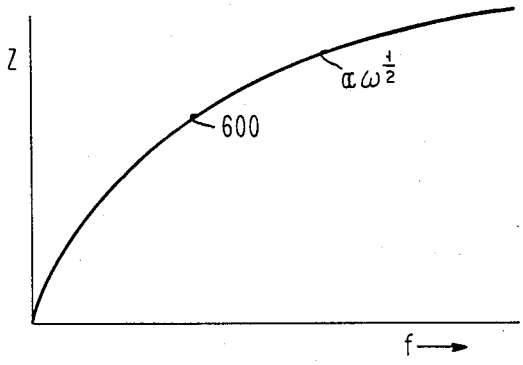

Diffusion in an electrochemical cell occurs according to Ficks' laws. Two types of materials enter into the design of the simulator according to the invention. For the surface bonded active species, examples of which are strongly adsorbed species, species bonded by way of silylation, and species attached to a coated polymer, a simple differentiating function is satisfied by means of a simple differentiating circuit having a series capacitor 56 and a shunt resistance provided by the input circuitry of the amplifier circuit 60 where both the oxidized and the reduced forms are soluble. Other species call for a semi-impedance network 58 and the shunt resistance. Keith B. Oldham, in his earlier work, has shown the inverse application of the network developed by Warburg for analyzing electrochemistry problems, whereby it is used here for synthesis in simulating an electrochemical cell. FIGS. 5 and 6 are graphical representations of phase-shift and impedance variations of a Warburg impedance network of the type shown.

One Warburg impedance network 58 for the purpose is constructed as shown with the component values:

a: 2.0 Kilohms
b: 6.3 Kilohms
c: 63. Kilohms
d: 630. Kilohms
e. 8300. Kilohms
f: 2.0 Kilohms
g: 20. Kilohms
h: 200. Kilohms
i: 2,000. Kilohms
j: 500. picofarads
k: 0.005 microfarads
l: 0.05 microfarads
m: 0.5 microfarads
n: 500 picofarads
o: 1,600. picofarads
p: 0.016 microfarads
q: 0.16 microfarads
r: 2.08 microfarads The capacitor 56 is of the order of 0.1 microfarads in this instance. This design approximates the function proportionally to the square root of the frequency component.

FIGS. 5 and 6 are graphical representations of the phase and frequency relationship in a Warburg impedance network over the same range of frequencies.

Briefly, in operation, the buffer amplifier 41 and the sense amplifier in turn determine the barrier layer potential and applies a gain correction to permit simulation of one-and two-electron processes. The matched diodes 46, 48 and the associated circuitry simulate the concentration. The compensating amplifier 80 compensates for the finite back resistance of the diodes 46, 48 under control of the feedback resistor 82. The capacitor 56, or the impedance element 58, and the input circuit of the amplifier 60 perform a desired fullor semi-differentiation function. Control of the simulated oxidation/reduction function obtains by throwing the switch 92 in the input circuitry of the offset amplifier 50. The amplifier 60 sources the simulated faradaic current into the working electrode current path, and the Howland pumping amplifier circuit 70 sinks that same current in the resistive cell element ($r_c+R_u$) current path.

There are three conventional components frequently encountered in the dummy cells. There is a choice of resistors (32') between the auxiliary electrode and the reference electrode to simulate the bulk resistance ($R_c$) of the electrolyte in that region. The associated potentiostat compensates for any voltage drop across this resistance and it is therefore referred to as the COMPENSATED RESISTANCE $R_c$. The electrolyte resistance between the reference electrode and the double layer is called the UNCOMPENSATED RESISTANCE $R_u$, even though modern potentiostats include circuitry which permits compensation of even this resistance. In this simulator, $R_u$ takes the form of a one kilohm rheostat 34'. Finally, a set of four capacitors (36') are available to simulate double layer capacitances from 0.01 to 10mf.

Assuming that the working electrode at the terminal 26 is essentially at ground potential, the potential of the non-inverting input to the buffer amplifier 41 is the double layer potential $e_b$. Since the amplifier 41 is configured as a unity gain buffer, the output thereof is also $e_b$.

The circuitry of the following amplifier circuit 42 performs two functions. An offset potential $e_o$ is added to the potential $e_b$ and a gain of either $\alpha$ or $2\alpha$ is available, depending on whether a one electron (n=1) or two electron (n=2) reaction is being simulated. The gain $\alpha$ has a value near unity and is adjusted to compensate for one of the non-ideal characteristics of the back-to-back diode pair in the simulator circuit 44. When n=1, the transfer function is $$e_2 = \tfrac{1}{2}\left(1 + \frac{R_2}{R_1}\right)(e_b + e_o). \tag{3}$$

The gain $\alpha$ is thus seen to be given by $$\alpha = \tfrac{1}{2}\left(1 + \frac{R_2}{R_1}\right) \tag{4}$$

where $R_1$ is the resistance.

The amplifier circuit 42, simulator circuit 44 and the associated amplifier circuits 50 and 80 which serve to tailor the remaining diode characteristics so that the output of the amplifier circuit 50 accurately duplicates the potential dependence as defined by the Nernst equation. Thus, the input current into the summing junction of the amplifier circuit 50 is required to take the forms $$i = \begin{cases} \dfrac{2I_s}{1 + \exp\left[-\dfrac{nF}{RT}(E_i - E_s)\right]}\ ;\ \text{oxidation} & (5) \\[2ex] -\dfrac{2I_s}{1 + \exp\left[\dfrac{nF}{RT}(E_1 - E_s)\right]}\ ;\ \text{reduction} & (6) \end{cases}$$

where $I_s$ is the limiting or saturation current.

$$e_4 = -iR_{eff} = \begin{cases} -2I_sR_{eff}\dfrac{n}{1+\exp\left[-\dfrac{nF}{RT}(E_i-E_s)\right]} & (7) \\ 2I_sR_{eff}\dfrac{n}{1+\exp\left[\dfrac{nF}{RT}(E_i-E_s)\right]} & (8) \end{cases}$$

The output of amplifier circuit 50 must also be scaled by n, the elementary number of electrons transferred, and for the sake of uniformity, the 100K trimmer resistor 102 in the feedback path of the amplifier circuit 50 is adjusted such that $2I_sR_{eff}=1.0$ volts. It is briefly noted that the amplifier circuit 80 compensates for the finite differential reverse resistance of the semiconductor diodes, that the switch 92 at the input of the amplifier circuit 50 selection between oxidation and reduction currents, and that the switch 106 at the output of the amplifier circuit 50 provides a selection between n=1 and n=2 simulation. This latter switch 106 is thrown together with the switch 110 in the feedback path of the amplifier circuit 42.

The output from the amplifier circuit 50 selectively drives a semi-differentiator circuit or a differentiating circuit, both in conjunction with the input subcircuit of the amplifier circuit 60. The driving potential is impressed across either the Warburg impedance circuit 58 or the capacitor 56, generating a current which respectively is the semi-derivative or full derivative of that potential. This current is proportional to the desired simulated Faradaic current. Potential proportional to this current is developed across the CONCENTRATION rheostat 64 and is used to source a current into the working electrode through the resistor 62 and is also used to sink a current from the double layer, as described hereinbefore by using the Howland current pump amplifier circuit 70.

Figure 7:
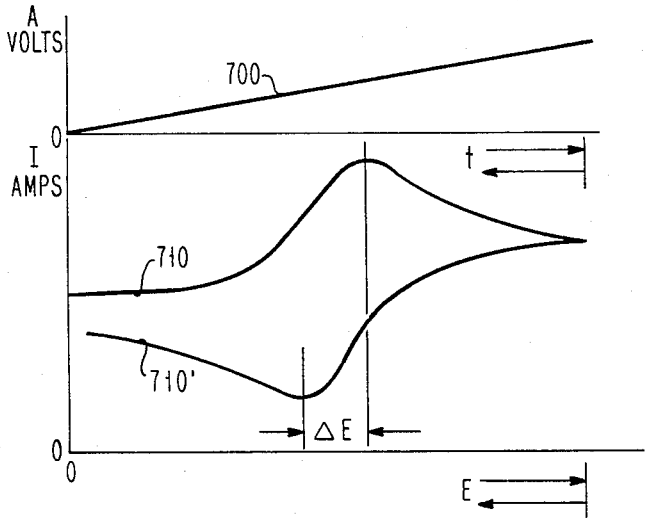
FIG. 7 is a graphical representation of waveforms applied to and resulting therefrom with an electronic simulating circuit arrangement according to the invention.

FIG. 7 is a reproduction of a graphical representation of waveform obtained with the circuit arrangement according to the invention. Referring to FIG. 1, a triangular waveform is applied to input terminals 132, 134. A cell under test on the simulator according to the invention will react with the circuit 20 and an output usually in the form of a plotter print will appear as a curve 710 and 710', the latter being a "foldback" of the former. The curve 700 also "folds back" insofar as the time scale is concerned and falls exactly upon itself. A measure ΔE, as shown, is of considerable analytic interest, being a measure of the reversibility of the reaction.

While the invention has been described in terms of an express embodiment, and alternatives have been suggested, it is clearly to be understood that those skilled in the art will effect further changes in form and in substance without departing from the spirit and scope of the invention as defined in the appended claims concluding the specification.

The invention claimed is:

1. An electronic circuit for simulating the electrical characteristics of an electrochemical cell comprising:

a plurality of impedance elements connected in series to partially simulate an electrochemical cell;

simulator circuit means for producing potential and current which define the faradaic resistance of said electrochemical cell;

means for connecting said simulator circuit means across one of said impedance elements;

said simulator circuit means including electronic impedance simulating circuitry for generating said current; and electronic current time-processing circuitry connected in series across said one of said impedance elements.

2. An electronic circuit as defined in claim 1, and wherein said electronic impedance simulating circuitry comprises a pair of semiconductor diode devices connected in back-to-back series relationship.

3. An electronic circuit as defined in claim 2, additionally comprising, electronic circuitry connected in parallel with said diode devices and arranged for compensating for the finite back-resistance of said diode devices.

4. An electronic circuit as defined in claim 1, and wherein said electronic current time-processing circuitry comprises differentiating circuitry.

5. An electronic circuit for simulating the electrical characteristics of an electrochemical cell comprising:

a first and a second interconnection terminal;

a first differential amplifier circuit having one input terminal coupled to said first interconnection terminal, having another input terminal and having an output terminal;

a second differential amplifer circuit having a first input terminal, having a second input terminal connected to a point of reference potential and having an output terminal;

a resistance simulator circuit having one terminal connected to said output terminal of said first amplifier circuit and having another terminal coupled to said first input terminal of said second amplifier circuit;

a third amplifier circuit having an input terminal coupled to the output terminal of said second amplifier circuit and having an output terminal;

a first resistor connected between the output terminal of said third amplifier circuit and said first interconnection terminal; and a second resistor connected between the output terminal of said second amplifier circuit and the second interconnection terminal whereby the circuit coupled between said first and said second interconnection terminals is operable to substantially simulate the faradaic resistance of said electrochemical cell.

6. An electronic circuit as defined in claim 5, and wherein said simulator circuit comprises two diode devices arranged in opposing conducting relationship in a series circuit between the output terminal of said first amplifier circuit and said first input terminal of said second amplifier circuit.

7. An electronic circuit as defined in claim 6, and wherein said diode devices are connected in back-to-back series relationship.

8. An electronic circuit as defined in claim 6, and wherein said diode devices have the anode electrodes connected in common.

9. An electronic circuit as defined in claim 7, additionally comprising:

a compensating operational amplifier circuit connected across said simulator circuit and having an adjustable feedback resistor.

10. An electronic circuit as defined in claim 7, additionally comprising:

a differentiating circuit interposed in the coupling between said simulator circuit and the input terminal of said third amplifier circuit.

11. An electronic circuit as defined in claim 10, and wherein said differentiating circuit comprises a series capacitor and the input circuitry of said third amplifier circuit.

12. An electronic circuit as defined in claim 10, and wherein said differentiating circuit comprises a Warburg impedance network and the input circuitry of said third amplifier circuit.

13. An electronic circuit as defined in claim 7, additionally comprising:

circuitry connected to said diode devices for further correcting for non-linearity of said devices.

14. An electronic circuit as defined in claim 13, and wherein said circuitry comprises adjustable potential divider circuitry and polarity selecting switching means.

* * * * *